United States Patent [19]

Knapke et al.

[11] Patent Number: 4,559,900

[45] Date of Patent: Dec. 24, 1985

[54] DEVICE FOR COATING STRIP MATERIAL

[75] Inventors: David M. Knapke, Northbrook; Kenneth C. Johnson, Des Plaines, both of Ill.

[73] Assignee: F. J. Littell Machine Co., Chicago, Ill.

[21] Appl. No.: 585,187

[22] Filed: Mar. 1, 1984

[51] Int. Cl.[4] ..... B05C 3/12

[52] U.S. Cl. ..... 118/672; 118/103; 118/117; 118/419; 118/424

[58] Field of Search ..... 118/102, 114, 115, 117, 118/424, 423, 419, 668, 672, 116, 103, 110, 44; 427/365, 359; 72/43–46; 413/18, 29

[56] References Cited

U.S. PATENT DOCUMENTS

| | | | |
|---|---|---|---|
| 2,309,585 | 1/1943 | Haddock | 118/117 |
| 2,315,150 | 3/1943 | Bobrov | 118/115 |
| 2,774,684 | 12/1956 | Fucinari | 427/365 |
| 2,823,641 | 2/1958 | Cook et al. | 118/115 |
| 2,906,018 | 9/1959 | Baker | 118/115 |
| 3,014,811 | 12/1961 | Storck | 427/359 |
| 3,974,949 | 8/1976 | Petersen | 72/43 |
| 3,987,750 | 10/1976 | Knapke | 118/44 |

*Primary Examiner*—John P. McIntosh

*Attorney, Agent, or Firm*—Willian, Brinks, Olds, Hofer, Gilson & Lione

[57] ABSTRACT

A device for applying a lubricant coating to strip material subsequently formed in an operation which necessitates uniform application of the lubricant. Propulsion rolls pull the strip through a lubricant bath and squeeze off excess lubricant to leave a relatively heavy and somewhat uneven coating of lubricant. The propulsion rolls drive the coated strip between metering rolls which have hardened metal surfaces roughened by grit blasting to achieve a uniform, pitted effect. The metering rolls exert substantial pressure on the thickly coated strip and cause separate and independent, limited volume patches of lubricant to be defined and adhere to the strip uniformly across its surfaces.

7 Claims, 7 Drawing Figures

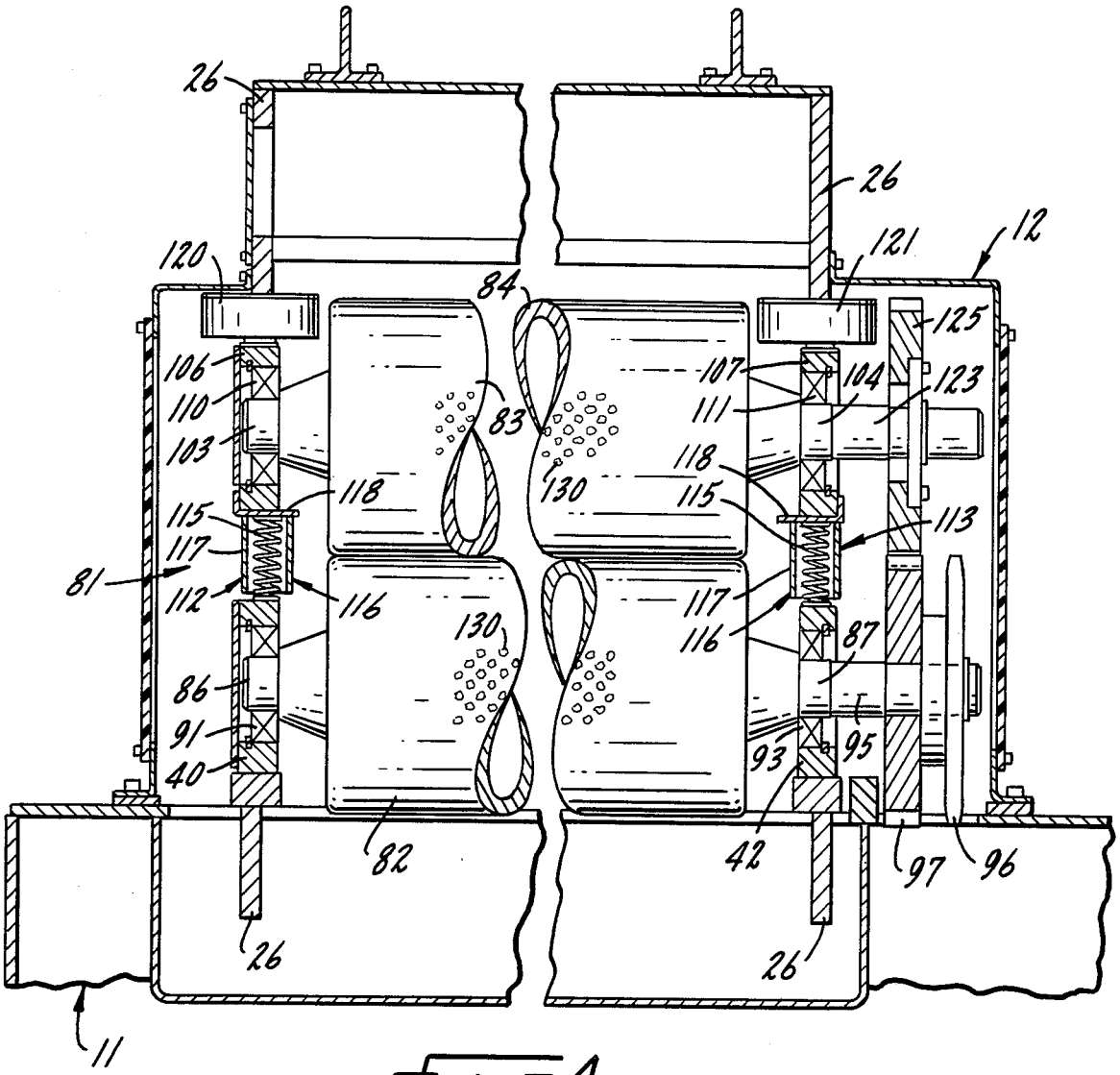
fig.4.
fig.6.
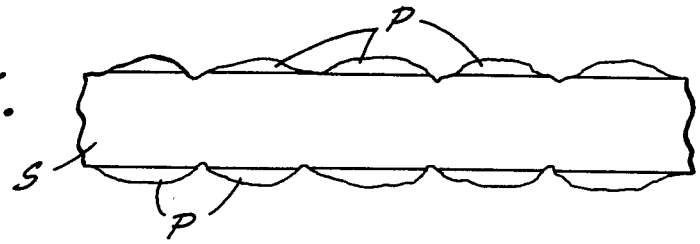
fig.7.
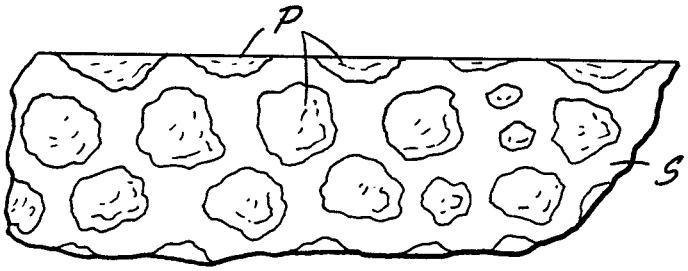

DEVICE FOR COATING STRIP MATERIAL

FIELD OF THE INVENTION

This invention is in the field of coating. It relates particularly to the application of a lubricant coating to a sheet of material prior to the material being drawn or otherwise worked.

BACKGROUND OF THE INVENTION

In the production of aluminum cans, for example, a strip of aluminum is fed to a die press from a coil in an uncoiling machine. The press punches out shallow, cup-shaped blanks from the strip. The cup-shaped blanks are "drawn" and "ironed" to form the bottom of a two piece aluminum can. The bottom is then mated with a separate top.

The press utilizes a compound die set in a two step operation. It punches out a circular blank and then forms the blank into a cup. The press formed cup is two (2) to three (3) inches high.

The short cup is then drawn out so that it has an elongated tubular body. The open end of the tubular body is ironed outwardly to form a lip. The top of the can is then attached to the lip.

These forming steps can be successfully carried out only if the strip of aluminum has a coating of lubricating fluid on it. Accordingly, it is conventional to apply a coating or film of lubricant to the surface of the aluminum strip before it enters the press operation.

Where relatively low speed die operations are involved lubricant film thickness can vary considerably without untoward effects. For example, older presses, which run at ninety (90) strokes per minute or less, require minimal control of lubricant film thickness. With these older, slow presses the lubricant is merely sprayed or wiped onto the aluminum strip.

With modern presses, where the speed is increased to between one hundred eighty (180) and two hundred forty (240) strokes per minute, however, control of lubricating film thickness becomes critical. Anywhere there is insufficient lubricant the die may blow through the cupping operation and rupture the aluminum strip. Anywhere there is too much lubricant the grippers which hold the cup while it is being drawn may lose their grip whereby the cup is not drawn properly.

To satisfy the needs of the faster, modern presses, various improved methods of applying lubricant were developed to supplant the traditional spraying or wiping operation. For example, a process involving electrostatic deposition of lubricant was developed. Another approach which was developed is called "roll coating" and involves the mechanical application of a lubricant film with the aid of lubricant coating rolls.

In the electrostatic deposition process, control of lubricant film thickness is quite precise. However, with this process film consistency begins to break down where stopping and starting of the strip is necessary, as it frequently is in practice. In such case the lubricant tends to "puddle up", i.e., form small pools on the strip surface and become uneven in thickness across the surface of the strip.

"Roll coating" machines have been relatively successful in applying a coating of lubricant which is uniform enough for the operation of modern presses. They normally include a first set of propulsion rolls which drive a strip of aluminum into a dip tank containing the lubricant. A second set of propulsion rolls pulls the strip out of the tank and "squeegees" off excess coating fluid. The second set of rolls also serves to compress the film or fluid against the strip and form a micro-fine film of lubricant on both the top and bottom of the strip. Each of the second set of rolls is polyurethane coated to a thickness of about one-half inch (½") so that they are compressible.

The second set of propulsion rolls drives the lubricated strip out of the roll coating machine into a holding loop between the machine and the press feed rolls. Upon demand from the press, feed rolls drive the strip into the press where the multiple cup forming operations are performed. The press feed rolls serve to further refine the thickness of the lubricant film, compressing the film against the surface of the strip just before it is fed to the die press. The result is a relatively well controlled lubricant film thickness and distribution.

The press feed rolls play an important part in controlling the lubrication film on the strip when a conventional roll coating machine is employed. In order to assure satisfactory lubrication film uniformity, they correspond in length to the width of the strip, i.e. they are full width rolls.

With conventional roll coating machines, full width rolls are also preferred because they flatten out edge burrs, which the roll coating rolls cannot do. Strips three (3) to four (4) feet in width are now conventional and strips as wide as five (5) or six (6) feet can be used with some of the newer presses. As the widths increase the rolls increase in length, accordingly. As long as press speeds do not exceed approximately one hundred and eighty (180) strokes per minute the use of such massive, high inertia feed rolls is not a problem. However, presses are now being constructed which operate at much higher speeds. As press speed increases the mechanical strip feed indexing mechanism can no longer cope with repetitively overcoming the substantial inertia of the feed rolls and the indexing mechanism tends to break down frequently. To prevent this, larger, more expensive cam drives must be employed.

Of course, the mass of the feed rolls can readily be reduced by shortening the rolls. Doing so, however, shortens them to a length less than the width of the strip. Where the feed roll does not contact the strip across its entire width, it has been found impossible to achieve a final uniform thickness of lubricating film utilizing conventional roll coating machines. The effect is to practically limit the use of conventional roll coating machines to press feeds of approximately two hundred and forty (240) strokes per minute or less.

Conventional roll coating machines also have other important shortcomings. The second set of propulsion rolls have a plastic, compressible material on their surface, as previously described. After a certain amount of use the plastic gets flat spots. As a result, the lubrication film thickness varies.

The fact that the rolls are covered with a relatively compressible material creates another problem. Both sets of propulsion rolls are driven through a gear train from the press at a speed directly related to that of the press. The pitch diameter of the gears which drive them determines the rotation speed of the propulsion rolls. As long as the surface diameter of each set of rolls is related identically to the pitch diameter of the drive gears the roll coater operates properly.

However, when the rolls of the second set of propulsion rolls squeeze together to grip the strip between them the roll diameter is changed because of the compressibility of the plastic surface. The relationship between the pitch diameter and the roll diameter vary with the amount of pressure applied. The two sets of propulsion rolls attempt to drive the strip at slightly different speeds. As a result, the second set or lubricant applicator rolls tend to slide on the surface of the strip, creating a wiping action and gaps in the lubricant film.

Still another problem which conventional roll coating machines have been unable to cope with satisfactorily relates to the fact that the aluminum strip has a coating of mill oil on it when it comes from the coil manufacturer. The coating is a lubricant itself so it is not inherently unattractive. Unfortunately, mill oil is not a substance which blends readily with water soluble lubricants employed in coating the strip prior to press forming. The adhesion characteristics of the mill oil are different than those of the water soluble lubricant. As a result, the squeegee action of the second set of propulsion rolls in a roll coating machine acts differently on patches of mill oil than it does on unoiled, dry strip lubricant. Puddling of the mill oil occurs and uneven lubricant film application results.

Other problems are also inherent in the gear drive and compressible surface propulsion roll relationship inherent in conventional roll coating machines. As press feed speed increase with increasing productivity requirements all problems are magnified. Solutions have not been found in traditional approaches.

SUMMARY OF THE INVENTION

An object of the present invention is to provide an improved device for applying a film of lubricant to a moving strip. Another object is to provide a device which produces a uniform film of lubricant on a strip of sheet metal regardless of the presence of patches of mill oil on the strip being treated. A further object is to provide a lubricant applicator device which flattens edge burrs and produces a uniform film of lubricant so that the following press feed rolls contact the entire surface of the strip. Still another object is to provide a device which applies lubricant in such a manner that puddling does not occur. Yet another object is to provide an applicator device which is simpler in construction and operation than conventional roll coating devices.

The foregoing and other objects are realized in accord with the present invention by providing an applicator device which, like known roll coating machines, utilizes two sets of rolls and a lubricant reservoir. Unlike known roll coating machines the invention employs a set of coating rolls downstream of the reservoir and a set of metering rolls downstream of the coating rolls. No propulsion rolls upstream of the reservoir are employed.

The coating rolls have a polyurethane surface. They pull the strip through the lubricant reservoir where it acquires a relatively thick and uneven coating of a suitable lubricant. Conventionally, that lubricant is water soluble. The coating rolls squeegee excess lubricant back downstream toward the reservoir, i.e., the resilient polyurethane roll surfaces compress against the coated strip and force all but a relatively thin film of the lubricant to flow back on the strip toward the reservoir.

The lubricant film which remains on the strip after the coating rolls have squeegeed it might vary in thickness from 0.001 to 0.005 inches. It covers both bare metal and patches of mill oil which remain on the strip. The strip, coated in this manner, proceeds to the metering rolls.

The metering rolls are not polyurethane covered. In fact, quite the opposite, they have hardened steel surfaces. The rolls comprise carburized, hardened steel tubing with a surface hardness of 60 Rockwell C. This surface is grit- blasted to provide a uniformly pitted surface finish of between RMS 230 and 280. The surface is then chrome-plated and a gravure effect remains on the plating surface.

The top metering roll is set on springs which urge it upwardly so it tends to separate from the bottom roll. Pneumatically operated pistons effective on the mounting shaft of the top roll urge it downwardly to overcome the effect of these springs and introduce a precise amount of pressure on the strip of aluminum passing between the rolls. The springs eliminate the weight of the rolls as a factor which must be considered in setting roll pressure. The pneumatic cylinders alone control pressure application.

According to the invention, the roll spacing is initially set at the thickness of the aluminum strip or less. The rolls thus apply pressure to the lubricant coated strip as it passes between them after leaving the coater rolls. Substantial pressure is brought to bear on the lubricant coating. The precisely dimensioned gravure finish on the rolls causes separate miniscule pools of lubricant to form in a uniform thickness and pattern across the entire surface of the strip.

Each pool of lubricant might contain only water soluble lubricant, only mill oil, or mixtures of both mill oil and water soluble lubricant. Because the pools have been separated by the application of pressure from the patterned roll surfaces, there is no surface tension effective between pools which would tend to cause them to coalesce. Accordingly, the film remains precisely uniform.

If a great amount of pressure is exerted, each individual pool of lubricant on the strip becomes pressurized. This is believed to increase the adhesion effect of each pool on the strip. It is also believed that high pressures actually force lubricant into the grain structure of the metal itself.

The gravure surface effect on the rolls does tend to microscopically deform the surface of the strip. However, the deformations are so small that they do not affect the can forming operations. The metal roll flattens edge burrs on the strip.

BRIEF DESCRIPTION OF THE DRAWINGS

Invention, including its construction and method of operation, is illustrated more or less diagrammatically in the drawings, in which:

FIG. 4 is a sectional view taken along line 4—4 of FIG. 2;

FIG. 6 is an enlarged side-elevational view of a segment of strip material coated with the device according to the present invention; and FIG. 7 is a top plan view of the strip segment illustrated in FIG. 6.

DESCRIPTION OF THE PREFERRED EMBODIMENT

Figure 1:
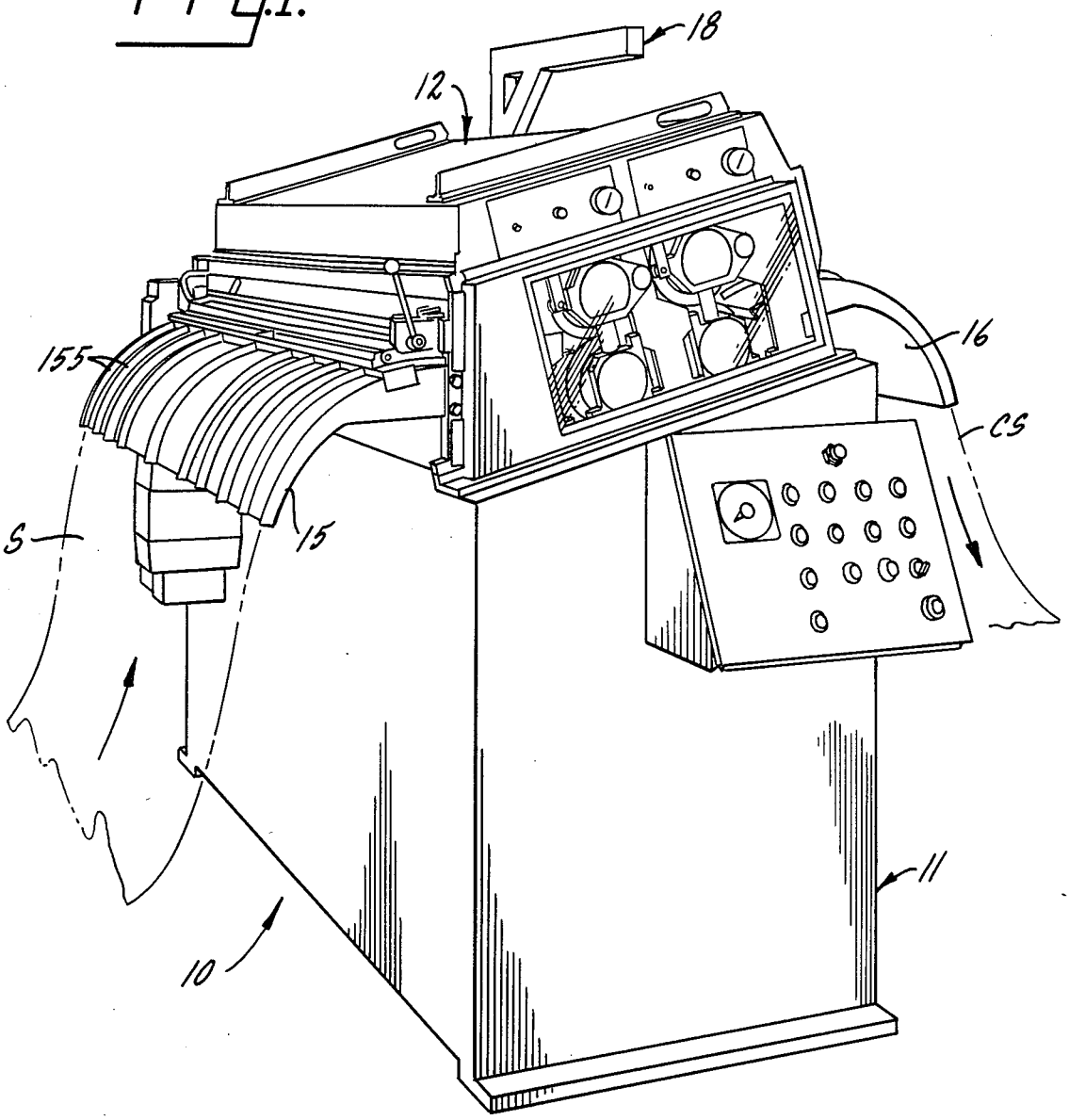
FIG. 1 is a perspective view of an improved device for applying a film of lubricant to a moving strip.

Referring now to the drawings, and particularly to FIG. 1, a coil strip lubricating device embodying features of the present invention is seen generally at 10. The lubricating device 10 includes a cabinet-like base 11 on top of which is mounted a lubricator head assembly 12. The device 10 is self-contained; it receives aluminum strip S from a conventional uncoiling machine (not shown), coats it with a lubricant film according to the invention, and discharges it into a holding loop for a punch press or the like (not shown).

The strip S of aluminum from the coiling machine (not shown) is drawn into the lubricator head assembly 12 over its catenary-entry support 15. The head assembly 12 applies a coating of lubricant to both the upper and lower surfaces of the strip S as it passes through the assembly. Coated strip CS is discharged over the catenary-exit support 16. Adjacent the catenary-exit support 16 is a "non-contact" ultrasonic sensing unit 18 (see FIG. 5) which senses the size of the output loop without disturbing the coating and signals the head assembly 12 to increase or decrease coating roll speed and maintain an average free loop of accumulated strip for feeding to the press.

Figure 2:
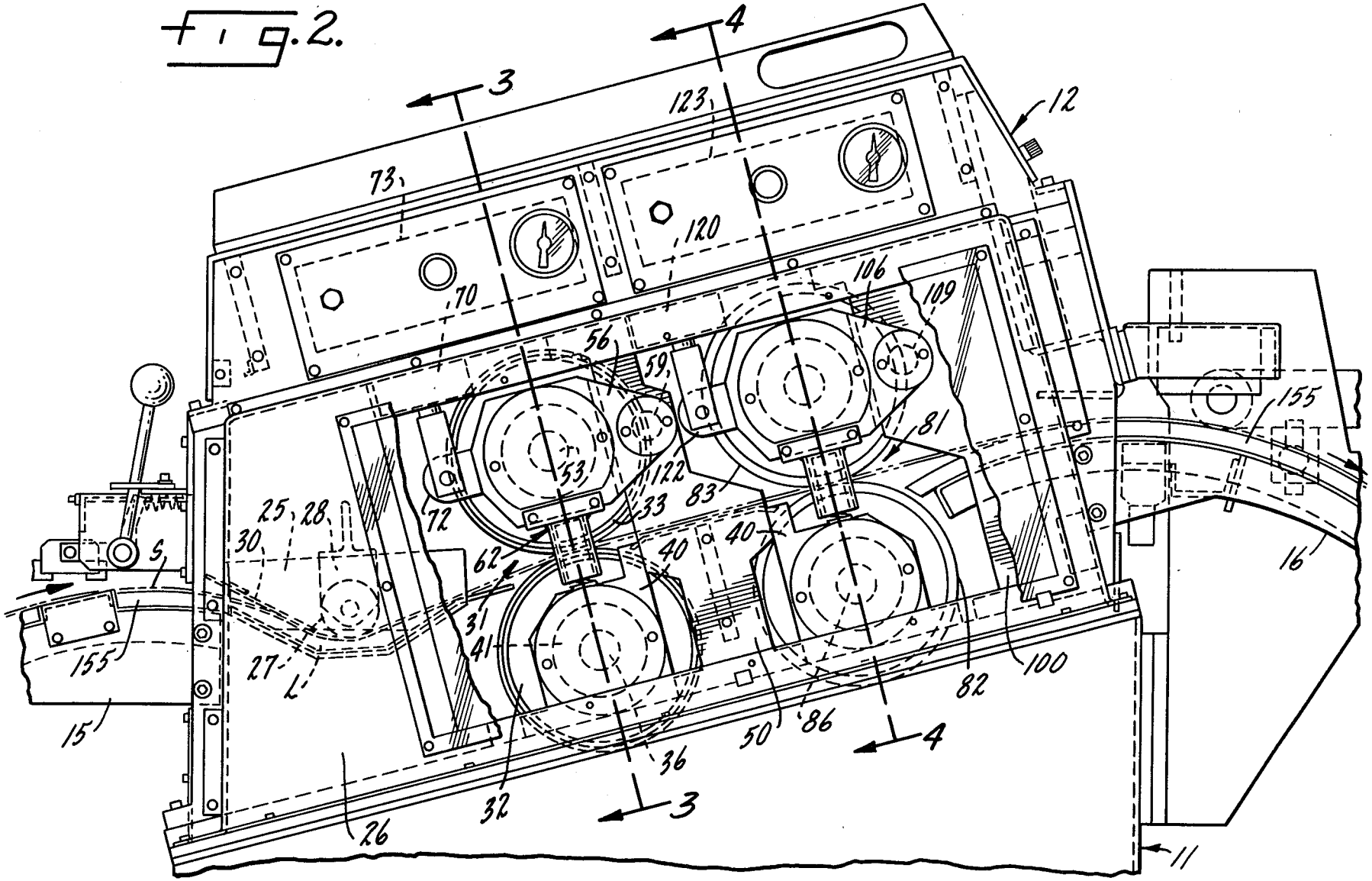
FIG. 2 is an enlarged side-elevational view, with parts removed, of the lubricator head assembly on the device of FIG. 1.

Referring now to FIG. 2, the strip S entering the coil lubricator assembly 12 is received by a lubricant trough 25. The trough 25 is supported between side frame members 26 (see FIG. 3) and is generally vee-shaped in cross-section. The trough 25 contains water soluble liquid lubricant L maintained at a predetermined level in a manner hereinafter discussed.

The trough 25 incorporates an idler roller 27 which extends downwardly below the surface of the lubricant L. The idler roller 27 is journaled between vertically extending legs 28 which fix it relative to the lubricant L level.

Adjacent the catenary entry support 15, in the trough 25, is a strip deflector plate 30. The deflector plate 30 serves to guide the incoming strip S downwardly into the lubricant L and under the idler roller 27.

Figure 3:
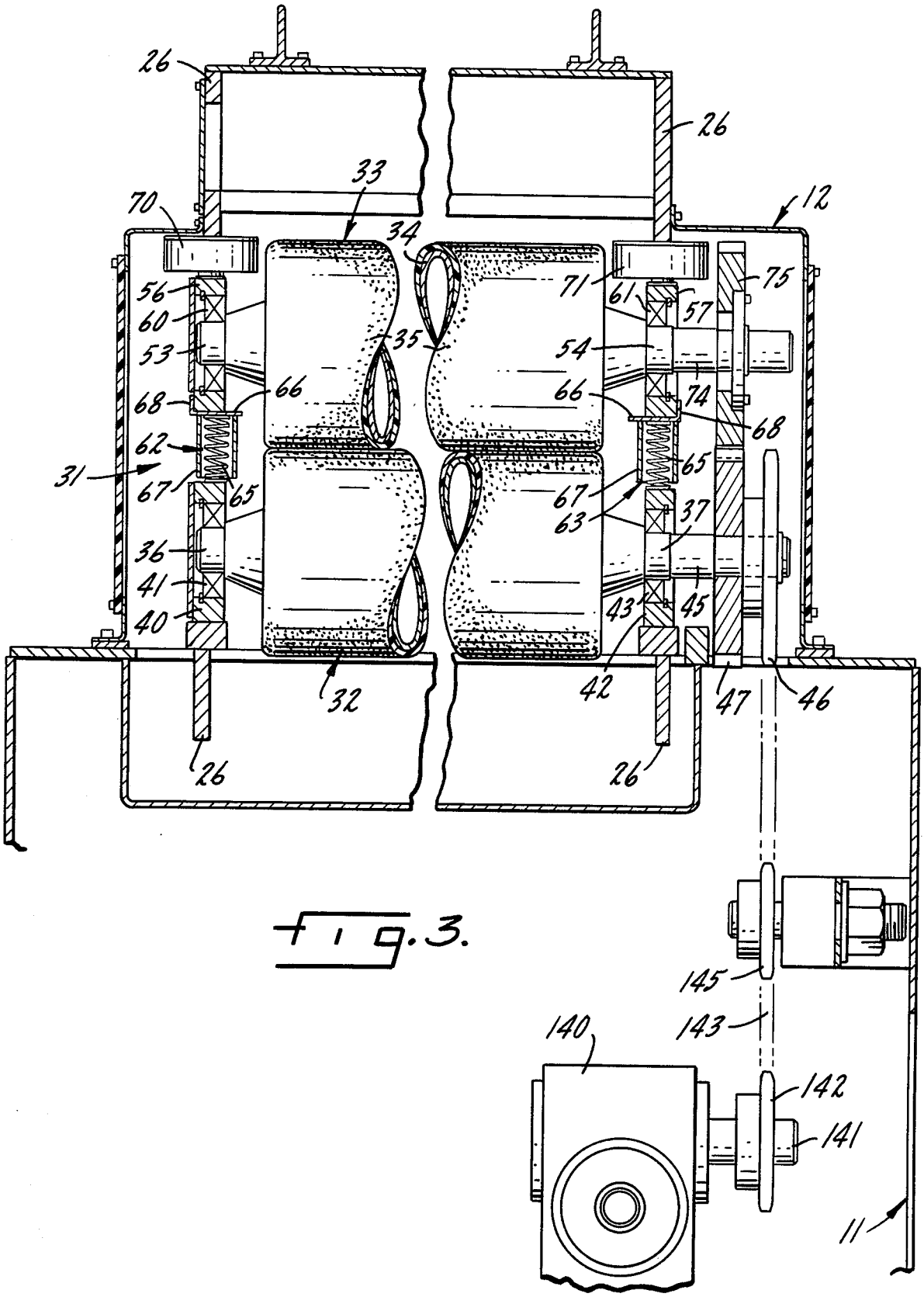
FIG. 3 is a sectional view taken along line 3—3 of FIG. 2.

The strip S is drawn through the lubrication trough 25 by a propulsion roll assembly 31, also mounted between the side frame members 26. The roll assembly includes a bottom roll 32 and a top roll 33. Referring to FIG. 3, the top roll 33 comprises a five inch (5") diameter steel cylinder 34 covered with a one-half inch (½") layer 35 of polyurethane. The construction of the bottom roll 32 is identical in this regard.

The bottom roll 32 has bearing stub shafts 36 and 37 extending from its opposite ends. The shaft 36 is mounted on a pillow block 40 in a conventional ball bearing ring 41. The shaft 37 is mounted on a pillow block 42 in a conventional ball bearing ring 43.

The shaft 36 is stubbed immediately outside the bearing ring 41. The shaft 37, on the other hand, extends outwardly of the bearing ring 43 in a shaft extension 45. The shaft extension 45 has a chain drive sprocket 46 affixed to its free end and a roll gear 47 affixed to the extension inwardly of the sprocket.

The pillow blocks 40 and 42 are seated in corresponding side frame members 26 which are cut out to receive them. Also seated in the side frame members 26 are mounting blocks 50 (only one shown, in FIG. 2) which support the top roll 33.

The top roll 33 is substantially identical to the bottom roll 32, as has been pointed out. It has stub shafts 53 and 54 extending from its opposite ends. Unlike the bottom roll 32, however, the stub shafts 53 and 54 of the top roll 33 are not mounted directly in the opposed mounting blocks 50.

Instead, a pair of roll mounting arms 56 and 57 are pivotally mounted, as at 59, for example, on corresponding mounting blocks 50. The arms 56 and 57 extend transversely of corresponding stub shafts 53 and 54 and incorporate identical bearing rings 60 and 61. The stub shafts 53 and 54 are seated in corresponding bearing rings 60 and 61.

The roll mounting arms 56 and 57 are prevented from pivoting freely down about their respective mounting points 59 by identical coil spring units 62 and 63. Each coil spring unit 62 and 63 includes a coil spring 65 and a spring retainer 66 surmounting it.

The spring 65 rests on top of a corresponding pillow block 40 or 42. The retainer 66 receives the spring 65 in its cup-shaped base 67 and supports the roll mounting arm 56 or 57 above it on a bearing plate 68.

The springs 65 are sufficiently powerful to urge the top roll 33 upwardly, away from the bottom roll 32. The effect of this is to remove the weight of the top roll 33 and its mounting structure as a factor in determining the amount of pressure which the top roll 33 applies to a strip S passing between the rolls.

According to the invention this pressure is applied and controlled by pneumatic cylinder activators 70 and 71 which connect the free end 72 of corresponding roll mounting arms 56 and 57 to the top of a corresponding side frame member 26. Air pressure supplied to the motors 70 and 71 from a pneumatic power and control unit 73 mounted on top of the side frames 26 uniformly urges the arms 56 and 57 downwardly against the force of the springs 65.

The operator controls the introduction of air under pressure to the activators 70 and 71 in a conventional manner through suitable valving (not shown in detail). The operator is able to adjust roll pressure with the control unit 73.

The stub shaft 54 of the top roll 33 extends outwardly of the bearing ring 61 in an extension 74. The extension has a roll gear 75 affixed to it, in mesh with the gear 47 on the bottom roll 32. The gears 75 and 47 are identical so that the two rolls 32 and 33 rotate at identical surface speeds.

The propulsion rolls 32 and 33, as they are called, are designed to pull the strip S through the lubricant L in the trough 25 and squeegee off excess lubricant. After doing so the rolls 32 and 33 propel the strip S, carrying a relatively thick coat of lubricant, to the metering roll assembly 81, seen again in FIG. 2.

The metering roll assembly 81 is also mounted between the side frame members 26. The roll assembly 81 includes a bottom roll 82 and a top roll 83. Referring to FIG. 4, the top roll comprises a six inch (6") diameter steel cylinder 84. The bottom roll 82 is constructed in identical fashion.

The bottom roll 82 has bearing stub shafts 86 and 87 extending from its opposite ends. The shaft 86 is mounted on the pillow block 40 in a conventional ball bearing ring 91. The shaft 87 is mounted on the pillow block 42 in a conventional ball bearing ring 93.

The shaft 86 is stubbed immediately outside the bearing ring 91. The shaft 87 extends outwardly of the bearing ring 93 in an extension 95. A chain drive sprocket 96 is affixed to the free end of the extension 95 and a roll gear 97 is affixed to it inwardly of the sprocket.

The pillow blocks 40 and 42 are seated in corresponding side frame members 26, as has been pointed out. Also mounted in the side frame members 26 are mounting (only one shown, in FIG. 2) blocks 100 which support the top roll 83.

The top roll 83 is substantially identical to the bottom roll 82. It has stub shafts 103 and 104 extending from its opposite ends. Like the top propulsion roll 33 and unlike the bottom metering roll 82 the stub shafts 103 and 104 of the top roll are not mounted directly in the opposed mounting blocks 100.

Instead, a pair of roll mounting arms 106 and 107 are pivotally mounted, as at 109, for example, on corresponding mounting blocks 100. The arms 106 and 107 extend transversely of corresponding stub shafts 103 and 104 and incorporate identical bearing rings 110 and 111.

The roll mounting arms 106 and 107 are prevented from pivoting freely down about their respective mounting points 109 by identical coil springs units 112 and 113. Each coil spring unit 112 and 113 includes a coil spring 115 and a spring retainer 116 surmounting it.

The springs 115 rest on top of corresponding pillow blocks 40 or 42. The retainer 116 receives the spring 115 in its cup-shaped base 117 and supports the roll mounting arm 106 or 107 above it on a bearing plate 118.

The springs 115 are sufficiently powerful to urge the top roll 83 upwardly, away from the bottom roll 82. As with the propulsion rolls 32 and 33 the effect of this is to remove the weight of the top roll 83 and its mounting structure as a factor in determining the amount of pressure which the top roll 83 applies to a strip S passing between the rolls.

Pressure is applied by pneumatic cylinder activators 120 and 121 which connect the free end 122 of corresponding roll mounting arms 106 and 107 to the top of a corresponding side frame 26. Air pressure supplied to the activators 120 and 121 from a pneumatic power and control unit 123 mounted on top of the side frames 26 uniformly urges the arms 106 and 107 downwardly against the force of the springs 115. The operator also controls the introduction of air under pressure to the activators 120 and 121 through the control unit 123.

The stub shaft 104 of the top roll 83 extends outwardly of the bearing ring 111 in an extension 124. The extension 124 has a roll gear 125 affixed to it in mesh with the gear 97. The gears 125 and 97 are identical and the rolls 82 and 83 rotate at identical surface speeds.

As has been pointed out, the metering rolls 82 and 83 each comprise steel cylinders. They are not coated with polyurethane. In fact, they are surface hardened by suitable heat treating to develop a surface hardness of 60 Rockwell C to a depth of one-eighth inch ($\frac{1}{8}''$).

The rolls 82 and 83 have a surface 130 which is uniformly pitted. The pitting is effected by grit blasting, using conventional techniques, to achieve a finish which, according to the invention, must be between RMS 230 and RMS 280. The pitted surface 130 is then chrome-plated, using conventional techniques, to provide a contour following layer of chrome plating which has a minimal thickness yet provides a long wearing surface which resists adhesion by aluminium dust.

Figure 5:
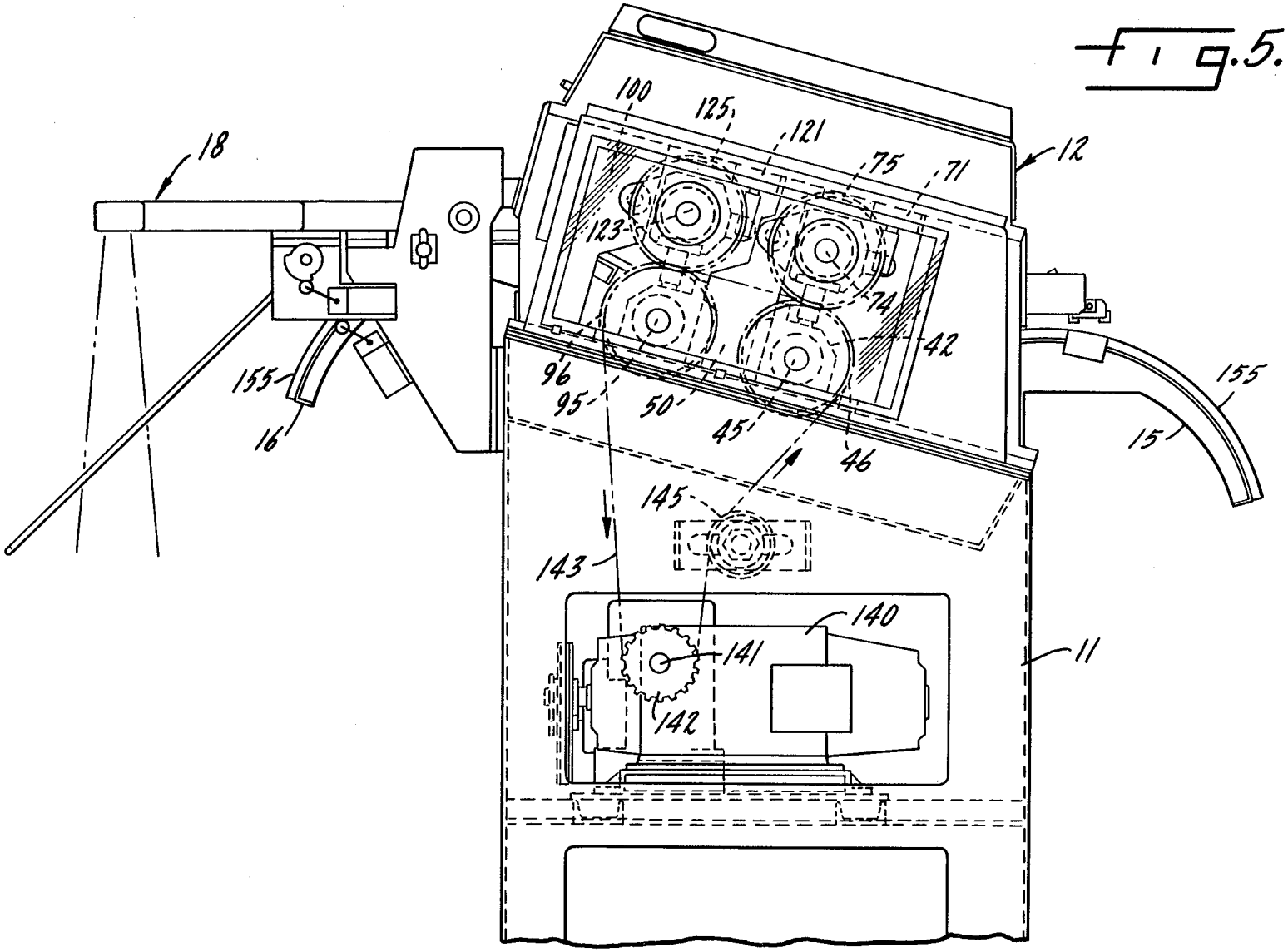
FIG. 5 is a side-elevational view, with parts removed, of the device illustrated in FIG. 1.

The chain drive sprockets 46 and 96 of the bottom rolls 32 and 82, respectively, are driven in unison by drive motor 140 mounted in the base 11 of the device 10, as seen in FIG. 5. The drive motor 140 is a conventional RELIANCE brand DC motor of less than 15 horsepower, mounted on suitable framing within the upper half of the base 11. It incorporates a conventional CLEVELAND brand speed reducer.

Mounted on the output shaft 141 of the motor 140 is a sprocket 142. A conventional drive chain 143 connects the sprocket 142 to the chain drive sprockets 46 and 96 on the rolls 32 and 82. Tension in the chain 143 is controlled in a conventional manner with an adjustable tension idler sprocket 145.

Rotation of the drive sprockets 46 and 96 by the motor 140 produces corresponding rotation of the bottom rolls 32 and 82, of course. Since the bottom rolls 32 and 82 are connected by roll gears 47 and 97 to the roll gears 75 and 125 of the top rolls 33 and 83, the top rolls rotate at precisely the same speed. According to the present invention that speed may be up to three hundred (300) feet per minute of strip feed.

As the propulsion rolls 32, 33 rotate they propel the strip S toward the metering rolls 82, 83, as has been pointed out. The strip S has acquired a coating of lubricant L in the trough 25. The pressure on the top roll 33 is set so that excess lubricant is squeegeed back toward the trough 25. Because the surfaces of the rolls 32, 33 are compressible, however, the lubricant coating left on the strip varies in thickness and distribution across the upper and lower surfaces of the strip S.

Lubricant in the trough 25 is maintained at a constant level in the reservoir from a pumping unit (not shown) in the base 11. The pumping unit operates continuously, through an adjustable flow meter, while strip is being fed.

The irregularly coated strip S passes between the metering rolls 82, 83 and the lubricant coating is regularized, in effect, according to the invention. The top roll 83 is subjected to sufficient pressure by the pneumatic cylinder activators 120 and 121 so that the gap between the rolls is no greater than and, preferably, is slightly less than the thickness of the strip S. As a result, substantial pressure is applied to the strip S and its coating of lubricant by the textured metering rolls 82, 83.

Referring now to FIGS. 6 and 7, the metering rolls 82, 83 produce a precise microscopic pattern of lubricant patches P on both the upper and lower surfaces of the strip S. The patches P are pressure positioned independently of each other so that surface tension does not cause them to coalesce. The patches are all within a very narrowly defined thickness range determined by the roll 82, 83 finish.

The gravure finish on the rolls 82, 83 is so hard that it actually creates a faint microscopic pattern in the strip S itself. However, the subsequent drawing operations in the press are effective to erase any trace of the pattern.

It is believed that the hard finish and substantial pressure of the rolls 82, 83 is actually effective to force lubricant between the grain structure at the surface of the strip S. As such, the lubricant is even more effective in promoting uniform drawing and ironing.

When the coated strip CS departs the metering rolls 82, 83 it passes out of the head assembly 12 and over the exit support 16, seen in FIG. 5. The exit support 16, like the entry support 15, incorporates a spaced series of support slide members 155, extending longitudinally of strip S and CS travel. They provide line contact support of the strip at each member 155.

A depending loop forms below an ultrasonic loop control unit 18. The loop control unit 18 senses the size of the loop, which actually forms a store of coated strip CS for the adjacent press (not shown), and adjusts the drive motor 140 as a function of feed demand.

While the embodiment described herein is presently preferred, it should be understood that various modifications and improvements may be made therein, and it is intended to cover in the appended claims all such modifications and improvements as fall within the true spirit and scope of the invention.

What is claimed is:

1. A device for applying lubricant to both surfaces of a strip of metal, comprising:

(a) a reservoir containing liquid lubricant;

(b) coating roll means for pulling the strip through said lubricant and squeegeeing off excess lubricant;

(c) metering roll means adjacent and downstream of said coating roll means;

(d) said metering roll means having a plated metal surface which has been uniformly roughened by grit blasting or the like;

(e) said metering roll means including a pair of rolls, the surfaces of which are spaced apart a distance corresponding to the thickness of the strip and constructed to form a plurality of spaced pools of lubricant on the surfaces of the strip; and (f) sensing means for sensing the altitude of the lubricant coated strip at a prescribed point after it leaves the metering rolls and controlling the device based on that altitude.

2. A device for applying lubricant to both surfaces of a strip of material, comprising:

(a) a reservoir containing liquid lubricant;

(b) roll means for propelling the strip through said source of lubricant including coating roll means locating downstream of said reservoir pulling the strip through the lubricant and squeegeeing off excess lubricant;

(c) metering roll means including a pair of metering rolls located downstream of said coating roll means for engaging opposite sides of the strip after it has passed through said source of lubricant and past said coating roll means and acquired a coating of lubricant, the gap between said rolls being no more than the thickness of said strip;

(d) said metering rolls each having a relatively hard, inflexible roughened surface which is operable to form a pattern of spaced pools of lubricant on the surfaces of the strip.

3. The device of claim 2 further characterized in that:

(a) both of said roll means are of a length sufficient to engage the full width of the strip surfaces.

4. The device of claim 2 further characterized in that:

(a) each of said metering rolls has a plated metal surface which substantially prevents metal dust build-up on the metering rolls.

5. The device of claim 4 further characterized in that;

(a) said plated metal surface is roughened so as to be substantially uniformly pitted.

6. The device of claim 5 further characterized in that:

(a) said plated metal surface is roughened to a surface finish of between RMS 230 and 280.

7. A device for applying lubricant to both surfaces of a strip of material, comprising:

(a) a reservoir containing liquid lubricant;

(b) coating roll means located downstream of said reservoir for pulling the strip through said lubricant and squeegeeing off excess lubricant;

(c) metering roll means adjacent and downstream of said coating roll means;

(d) said metering roll means having a plated metal surface which has been uniformly roughened by grit blasting or the like;

(e) said metering roll means including a pair of rolls, the surfaces of which are spaced apart a distance corresponding to the thickness of the strip and constructed to form a plurality of spaced pools of lubricant on the surfaces of the strip.

* * * * *